US006688150B1

(12) United States Patent
Westley et al.

(10) Patent No.: US 6,688,150 B1
(45) Date of Patent: Feb. 10, 2004

(54) ROLL GROOVING APPARATUS

(75) Inventors: Todd A. Westley, Elyria, OH (US); Richard W. Ballas, Westlake, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/298,306

(22) Filed: Nov. 18, 2002

(51) Int. Cl.[7] ..... B21D 15/04

(52) U.S. Cl. ..... 72/106; 72/105; 72/2; 100/341; 100/349

(58) Field of Search ..... 72/105, 106, 149, 72/214, 217, 428, 456, 2; 100/341, 345, 349, 350, 351, 352

(56) References Cited

U.S. PATENT DOCUMENTS

| | | | | | |
|---|---|---|---|---|---|
| 3,933,089 | A | * | 1/1976 | Spooner | 100/349 |
| 4,041,997 | A | * | 8/1977 | Selfe | 144/136.95 |
| 5,440,815 | A | * | 8/1995 | Inkster | 30/390 |
| 5,778,715 | A | | 7/1998 | Lippka et al. | |
| 5,931,039 | A | * | 8/1999 | Yoshimizu et al. | 72/217 |

OTHER PUBLICATIONS

The Ridge Tool Company, RIDGID Catalog No. RT–199, Jan. 1999, pp. 31,32 and 58.

Victaulic Company of America, Operating and Maintenance Instructions Manual for VE416 FS and VE416FSD, pp. 5–10 and 13–15, copyright 1997.

Victaulic Company of America, Operating and Maintenance Instructions for VE272FS, p. 6–15, copyright 1997.

* cited by examiner

*Primary Examiner*—Ed Tolan

(74) *Attorney, Agent, or Firm*—Fay, Sharpe, Fagan, Minnich & McKee

(57) ABSTRACT

Roll grooving apparatus for rolling a circumferential groove in a pipe comprises a first support rotatably supporting a first grooving roll, a second support rotatably supporting a second grooving roll and being displaceable relative to the first support for displacing the second grooving roll toward and away from said first grooving roll, a stabilizer on the first support for stabilizing a pipe to be roll grooved, and first and second guards pivotally mounted on the second support for displacement therewith. The first guard engages the stabilizer, the second guard engages a pipe being roll grooved during a roll grooving operation and each guard is spring biased to engage the corresponding one of the stabilizer and a pipe being roll grooved. A member on the first support engages and displaces the second guard away from a pipe which has been roll grooved when the second support is displaced to move the second grooving roll away from the first grooving rolls.

52 Claims, 6 Drawing Sheets

ROLL GROOVING APPARATUS

BACKGROUND OF THE INVENTION

This invention relates to the art of roll grooving apparatus and, more particularly, to improvements in such apparatus relating to roll and stabilizer guards therefor.

The present invention finds particular utility in connection with portable roll grooving apparatus of the character removably supported on a separate power drive unit which includes spaced apart and parallel support elements for the roll groover and a drive motor having a drive coupling for driving interconnection with a drive shaft of the roll grooving apparatus. While the invention will be illustrated and described herein in connection with such a portable roll groover, it will be understood and appreciated from the disclosure herein that the invention is applicable to other roll grooving apparatus including apparatus integrally mounted on a support and/or drive mechanism.

Generally, roll grooving apparatus includes relatively displaceable first and second support components which respectively rotatably support a driven grooving roll and an idler grooving roll between which a pipe to be grooved is interposed during a roll grooving operation. The grooving rolls are matingly contoured and, in this respect, the driven roll is provided with a peripheral groove and the idler roll is provided with a peripheral projection such that a pipe therebetween is provided with a peripheral groove upon relative rotation of the grooving rolls and relative radial displacement of the grooving rolls toward one another. Displacement of the support components toward and away from one another is achieved in a number of different ways, such as, for example, by a hand or foot operated hydraulic pump, or manually operated force applying arrangements including, for example, force multiplying lever arrangements and screw mechanisms. Further, such roll grooving apparatus often includes a pipe stabilizer arrangement extending laterally outwardly from one side of the apparatus. The stabilizer generally includes a support member slidably supporting a carriage which is displaceable laterally inwardly and outwardly of the apparatus by a crank at the outer end of the support and which includes a rotatable wheel for engaging and stabilizing a pipe being roll grooved.

Many roll grooving machines of the foregoing character include a roll and/or stabilizer guard interposed between an operator of the machine and the grooving rolls and/or stabilizer. Heretofore, such guards have either been stationary with respect to the apparatus or required manual adjustment relative to the apparatus in conjunction with the roll grooving of each different size of pipe within a range of pipe sizes. Such adjustment has, for example, been achieved through the use of bolt, slot and wing nut arrangements. In any event, the inability to adjust the position of a permanently mounted or stationary guard in conjunction with the roll grooving of different sized pipes detracts from the effectiveness of the guard. Additionally, a stationary guard is in the same position for each different size pipe in a range of pipe sizes and, thus, can have optimum effectiveness with respect to just one of the different pipe sizes within the given range. The necessity to manually adjust the position of a guard to accommodate different ranges of pipe sizes is time consuming and thus takes away from production time. In addition to requiring time to make such adjustments, adjustment procedures are sometimes ignored by the machine operator, thus reducing the effectiveness of the guard or guards.

SUMMARY OF THE INVENTION

In accordance with the present invention, a guard is provided for roll grooving apparatus which optimizes the effectiveness of the guard for each and every different size of pipe to be roll grooved by the apparatus. More particularly in this respect, a guard in accordance with the invention is mounted on the support member for the idler grooving roll which is displaced relative to the driven roll. Accordingly, the guard is displaceable with the support member, and its position relative to a pipe being roll grooved is automatically and continuously adjusted to optimize its effectiveness. In this respect, for example, if the apparatus includes a stabilizer and a guard associated therewith, the guard engages the stabilizer during a roll grooving operation and is maintained in contact therewith during the roll grooving operation. The position of the guard is adjusted each time the stabilizer is adjusted to accommodate the roll grooving of a different size pipe. If the guard engages a pipe being roll grooved, the position of the guard is likewise automatically adjusted in connection with the size of the pipe. If the apparatus includes a stabilizer, two guards are preferably provided, one for engaging the stabilizer and the other for engaging a pipe being roll grooved. The automatic adjustment of the position of a guard relative to one or the other or both the stabilizer and pipe during a roll grooving operation optimizes the effectiveness of the guard or guards in conjunction with the roll grooving operation.

In accordance with another aspect of the invention, a guard associated with the apparatus for engagement with a pipe being roll grooved preferably interengages with a fixed stop on the support member for the driven grooving roll when the idler roll is displaced away from the driven roll following a roll grooving operation. The stop and guard interengage to displace the guard away from the roll grooved pipe. This facilitates removal of the grooved pipe from between the grooving rolls and also optimizes access to the grooving rolls for changing the roll set.

Preferably, a guard according to the invention is pivotally mounted on the support member for the idler roll and is spring biased to engage one or the other of a stabilizer and a pipe being roll grooved. Accordingly, the position of the guard is self-adjusting, constantly and positively with respect to a pipe being roll grooved and does not require any input from the operator to assure that the guard is properly positioned at all times.

It is accordingly an outstanding object of the present invention to provide an improved guard arrangement for roll grooving apparatus.

Another object is the provision of a guard arrangement for roll grooving apparatus in which the position of one or more guards on the apparatus is self-adjusting relative to the grooving rolls.

A further object is the provision of a guard arrangement of the foregoing character wherein the effectiveness of one or more guards is the same for each pipe in a range of pipe sizes to be roll grooved.

Still another object is the provision of a guard arrangement for roll grooving apparatus in which a guard or guards mounted on a displaceable roll grooving support member for displacement therewith engage one or the other or both of a stabilizer on the apparatus and a pipe being roll grooved during a roll grooving operation to provide a constant effectiveness with respect to the position of the guard or guards independent of the size of the pipe being roll grooved.

Yet a further object is the provision of a guard arrangement of the foregoing character in which a guard interposed between an operator and one of the laterally opposite sides of the grooving rolls is displaceable laterally outwardly of the rolls in response to displacement of the idler roll away from the driven roll to facilitate removal of a pipe from between the rolls following a roll grooving operation and to optimize access to the grooving rolls to facilitate roll changing.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Figure 1:
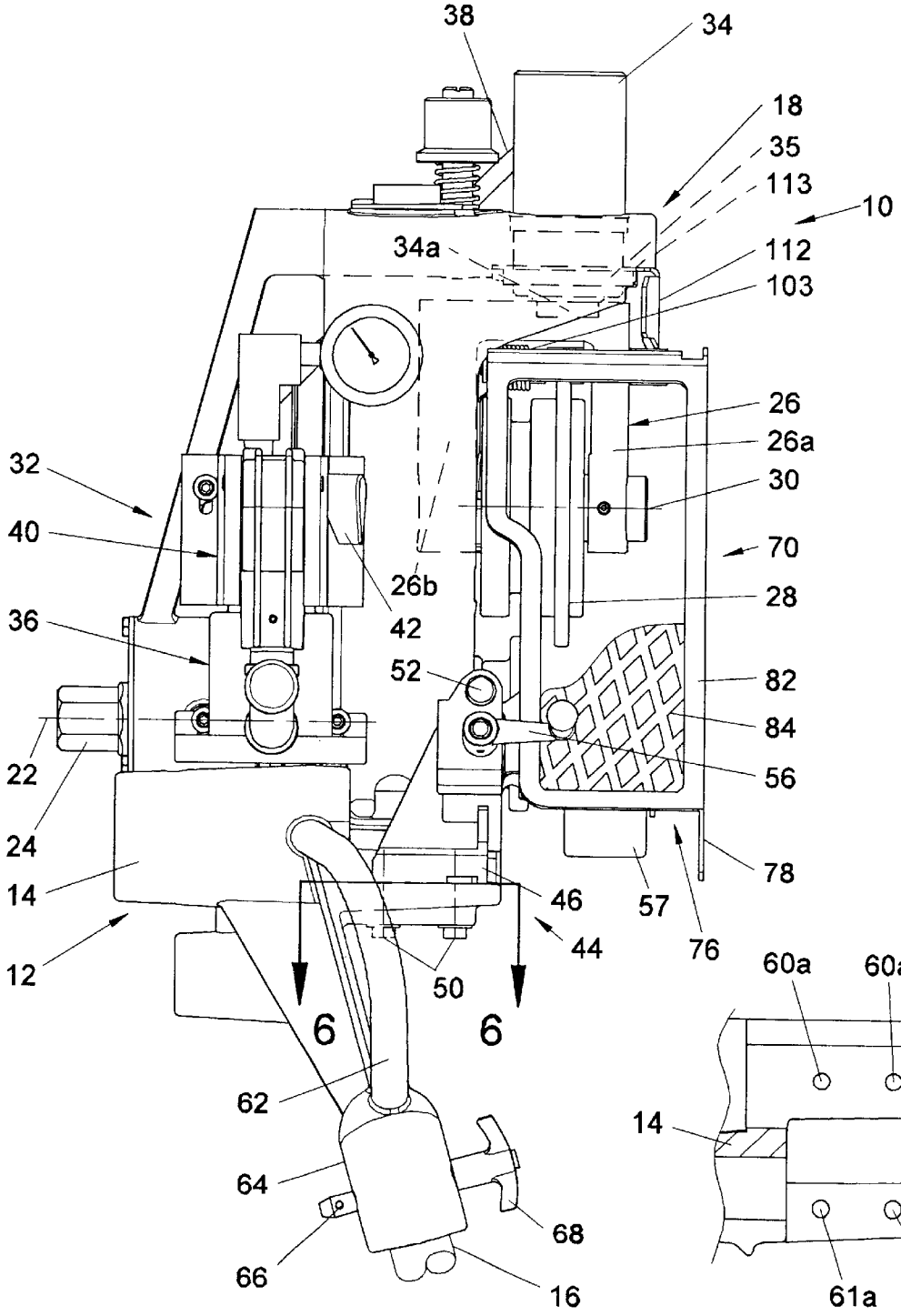
FIG. 1 is a side elevation view of roll grooving apparatus having a guard arrangement according to the invention.

Referring now in greater detail to the drawings, wherein the showings are for the purpose of illustrating a preferred embodiment of the invention only, and not for the purpose of limiting the invention, FIGS. 1–5 illustrate roll grooving apparatus 10 which is adapted to be mounted on the support rods of a power drive unit mounted on a stand such as, for example, a RIDGID 300 Power Drive and 1206 Stand available from Ridge Tool Company of Elyria, Ohio. The mounting of the apparatus in this respect is shown in FIG. 1 of co-pending application Ser. No. 10/292,861, filed Nov. 13, 2002, and assigned to the same assignee as the present application. For such mounting, roll grooving apparatus 10 is provided with a supporting base 12 having sleeves 14 for slidably receiving the support rods of the power drive unit. A pair of legs 16, only partially shown in FIGS. 1–3, depend from base 12 for engaging a surface such as a floor beneath the roll grooving apparatus. The latter arrangement together with features of the roll grooving apparatus to be described enables the apparatus to be used for roll grooving a larger range of pipe sizes than heretofore possible.

Roll grooving apparatus 10 includes a first support member 18 which is bolted or otherwise secured to base 12 and which rotatably supports a first or driven grooving roll 20 for rotation about a corresponding grooving roll axis 22. Further, grooving roll 20 is mounted on a drive shaft, not shown, for rotation about axis 22 and the drive shaft has a driven end 24 which, in a well-known manner, is adapted to be drivingly coupled with the chuck of the power drive unit. Accordingly, grooving roll 20 is driven about axis 22 in response to operation of the power drive unit. Roll grooving apparatus 10 further includes a second support member 26 having axially outer and inner portions 26*a* and 26*b*, respectively, between which a second or idler grooving roll 28 is mounted for rotation about a corresponding grooving roll axis 30. Inner portion 26*b* of support member 26 is mounted on support member 18 for sliding displacement relative thereto so as to move grooving roll 28 toward and away from grooving roll 20. In the embodiment illustrated, displacement of support member 26 and thus grooving roll 28 toward grooving roll 20 is achieved through a manually operable hydraulic pump assembly 32. The latter is operable as set forth below to deliver hydraulic fluid under pressure to a fluid actuator 34 mounted on support member 18 by a mounting nut 35 and which actuator has a piston rod 34*a* attached to support member 26 for displacing the latter and thus roll 28 toward roll 20. A spring between support members 18 and 26, not shown, biases support member 26 in the direction to move grooving roll 28 away from grooving roll 20.

Pump assembly 32 comprises a hydraulic pump cylinder 36 having a vertical axis 37, and hydraulic fluid under pressure is adapted to be delivered between cylinder 36 and actuator 34 through a line or hose 38 therebetween. The delivery of hydraulic fluid under pressure to actuator 34 is achieved by manually pivoting a pump operating lever 40 relative to cylinder 36 about a horizontal lever axis 41. In operation of the pump mechanism, the latter includes a release lever 42 having a closed position in which displacement of lever 40 upwardly and downwardly provides for the delivery of hydraulic fluid under pressure through line 38 to actuator 34 to displace support member 26 and thus grooving roll 28 downwardly toward grooving roll 20. As is well known, such downward displacement of grooving roll 28 with a pipe interposed between the grooving rolls results in producing a groove in the pipe in response to operation of the power unit to rotate grooving roll 20 and thus the pipe being roll grooved. When a roll grooving operation is completed, the power unit is turned off and release valve 42 is displaced to its open position which provides for fluid under pressure in actuator 34 to be delivered back to cylinder 36 through line 38, such displacement of the fluid occurring during displacement of support member 26 and thus grooving roll 28 away from grooving roll 20 by the biasing spring between support members 18 and 26.

Figure 6:
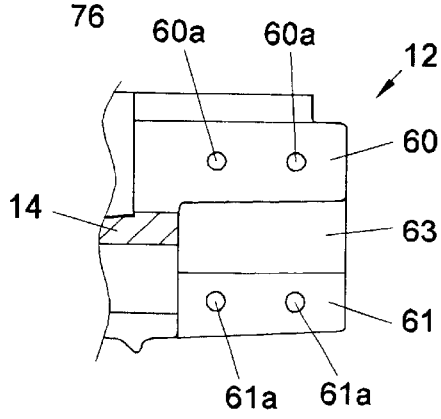
FIG. 6 is a plan view taken along line 6—6 in FIG. 1 and showing the stabilizer mounting arrangement; and, FIG. 7 is a plan view, in section, taken along line 7—7 in FIG. 4 and showing the pivotal mounting of the guards.
Figure 2:
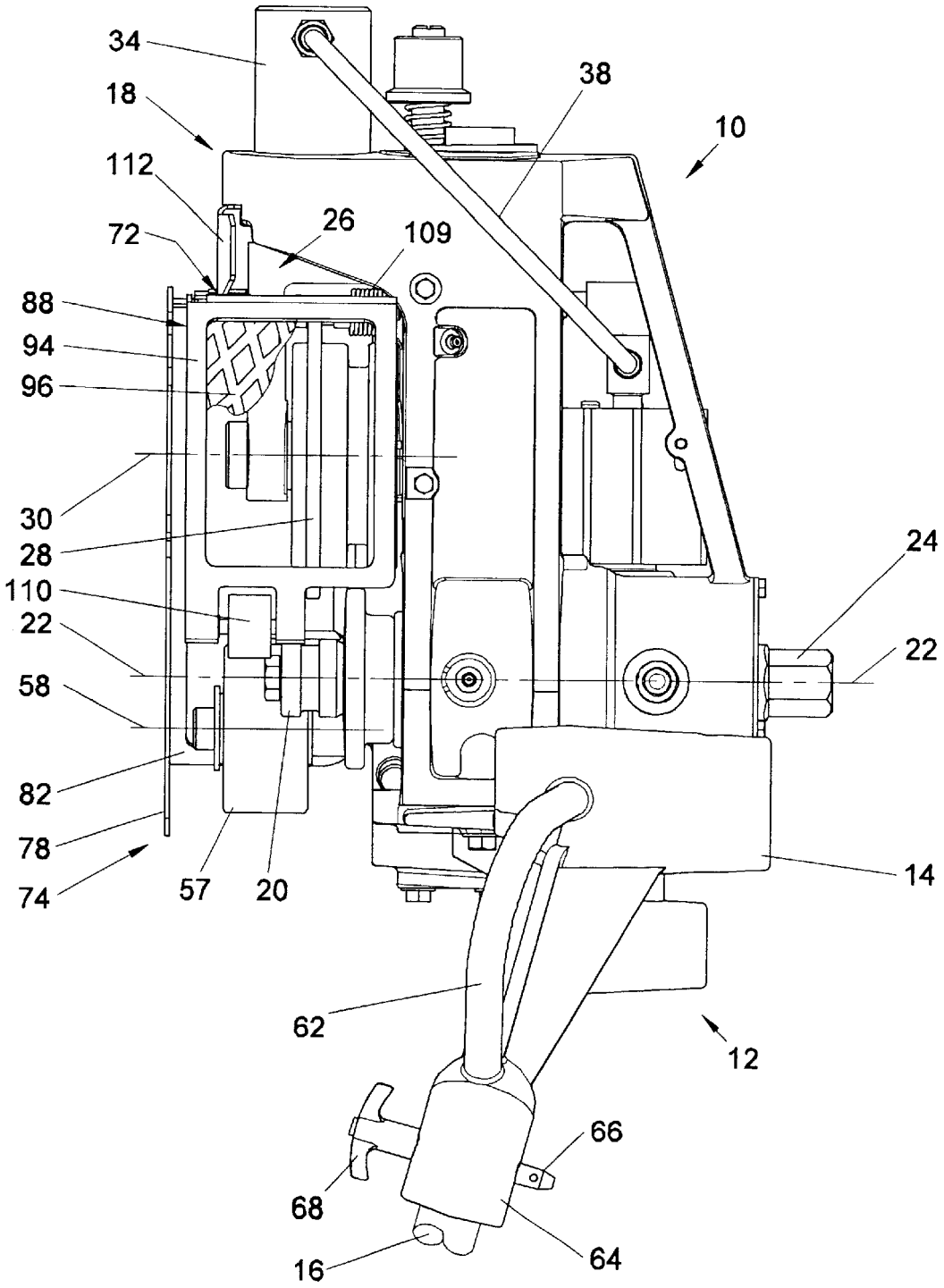
FIG. 2 is a side elevation view of the opposite side of the roll grooving apparatus shown in FIG. 1.
Figure 4:
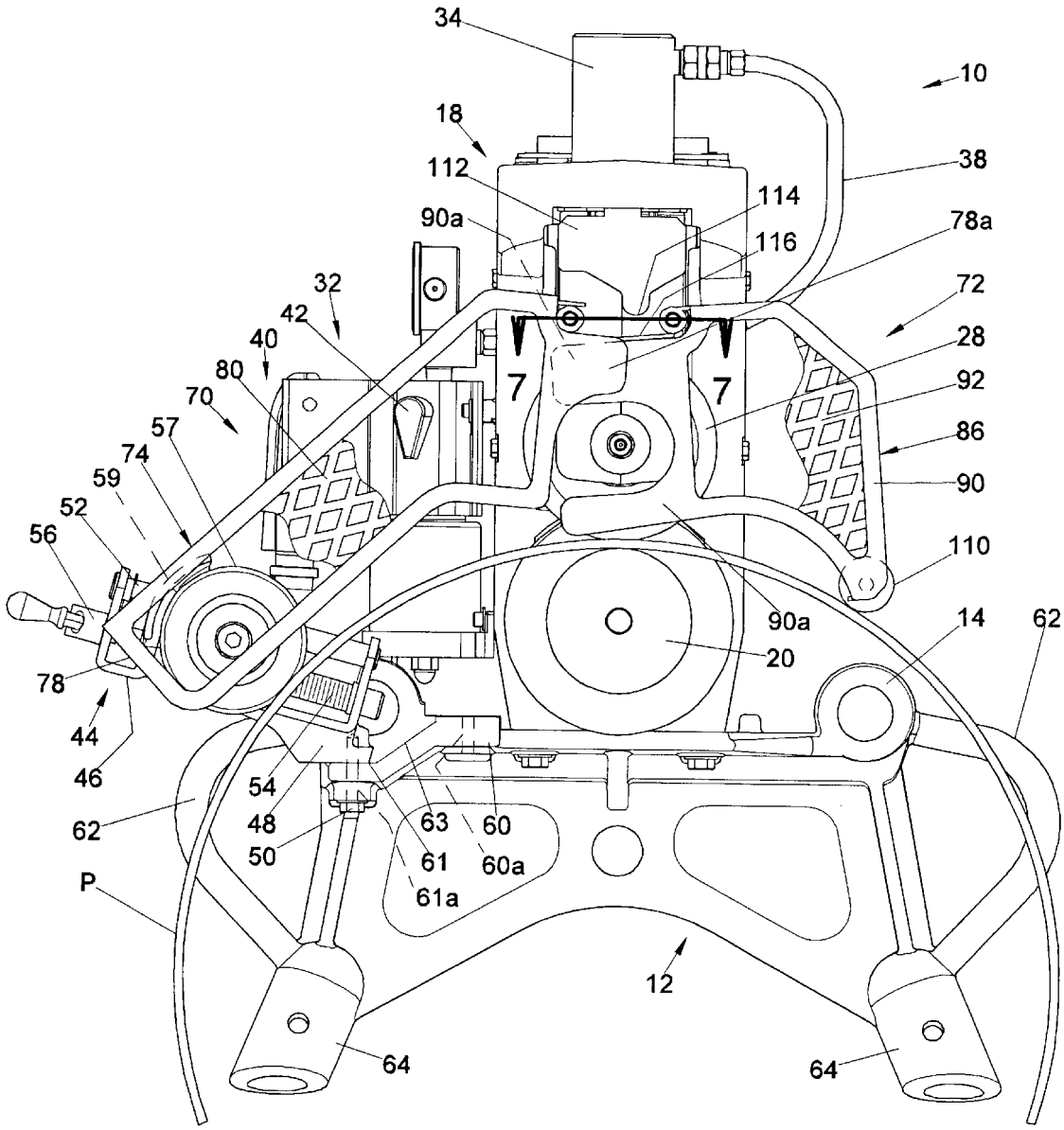
FIG. 4 is a front elevation view showing the roll grooving apparatus and guard arrangement in conjunction with the roll grooving of a large diameter pipe.

In the illustrated embodiment, apparatus 10 further includes a stabilizer assembly 44 mounted on base 12 on the same side of the apparatus as pump assembly 32. Stabilizer assembly 44 extends laterally outwardly of the one side and includes a support member 46 having an inner end 48 attached to base 12 such as by bolts 50. The stabilizer further includes a carriage, not designated numerically, supported for displacement laterally inwardly and outwardly of the apparatus by a rod 52 and a feed screw component 54 on support member 46 and which feed screw is adapted to be rotated in opposite directions by a crank 56 interconnected with the outer end thereof. The inner end of carriage 52 is provided with a stabilizer wheel 57 which is mounted thereon for rotation about a wheel axis 58 and which, as is well known, is adapted to engage the outer surface of a pipe being roll grooved so as to stabilize the pipe during roll grooving thereof. The carriage also includes a stabilizer wheel shield 59 extending about a laterally outer portion of the wheel. Stabilizer assembly 44 is adapted to be mounted on base 12 at either one of two laterally spaced apart locations thereon. In this respect, for example, and as shown in FIGS. 4 and 6 of the drawing, base 12 is provided with inner and outer mounting ledges 60 and 61 and a downwardly and outwardly inclined ramp 63 therebetween, and ledges 60 and 61 are provided with pairs of stabilizer mounting holes 60*a* and 61*a*, respectively. As shown in FIG. 4, mounting holes 61*a* receiving bolts 50. This arrangement advantageously allows the same, small size stabilizer used for roll grooving pipe from two inches to sixteen inches, for example, to be used in roll grooving pipe ranging from sixteen inches to twenty-four inches in diameter on the same machine. As will be appreciated from FIGS. 4 and 5, small diameter pipe is accommodated simply by remounting the stabilizer at the laterally inner mounting holes 60*a*.

Base 12 of the roll grooving apparatus is provided with handles 62 on the laterally opposite sides thereof which facilitate the mounting and removal of the apparatus from the support rails of the power drive unit and the transporting of the apparatus from one location to another. Further in this respect, base 12 is provided with tubular sockets 64 for receiving the upper end of the corresponding one of the legs 16, and the legs are removably retained in sockets 64 by pins 66 which extend through aligned openings therefor in sockets 64 and the upper ends of the legs. Pins 66 are provided with knobs or handles 68 on one end thereof to facilitate introducing the pins through the openings in the sockets and legs.

In accordance with the present invention, roll grooving apparatus is provided with an improved guard arrangement interposed between the grooving rolls and an operator of the apparatus. In the embodiment herein illustrated and described, the guard arrangement includes guards 70 and 72 on laterally opposite sides of the roll axes. As will be appreciated from FIG. 3; for example, guard 70 is interposed between an operator on one side of the apparatus and the stabilizer wheel and grooving rolls on that side, and guard 72 is interposed between the operator and the grooving rolls when the operator is on the other side of the apparatus. Preferably, each of the guards includes a panel transverse to the roll axes and a panel parallel to the roll axes, each panel being defined by a peripheral frame and an expanded metal window, whereby the component parts of the apparatus can be seen therethrough. More particularly in this respect, guard 70 includes a panel 74 transverse to the roll axes and a panel 76 parallel to the roll axes. Panel 74 includes a peripheral frame 78 extending about and secured such as by welding to an expanded metal window 80, and panel 76 includes a peripheral frame 82 extending about and secured such as by welding to an expanded metal window 84. Frames 78 and 82 of the two panels can be integral along the line of juncture thereof between the two panels. Similarly, guard 72 is comprised of a panel 86 transverse to the roll axes and a panel 88 parallel to the roll axes. Panel 86 includes a peripheral frame 90 extending about and suitably secured such as by welding to an expanded metal window 92, and guard 88 includes a peripheral frame 94 extending about and secured such as by welding to an expanded metal window 96.

Figure 3:
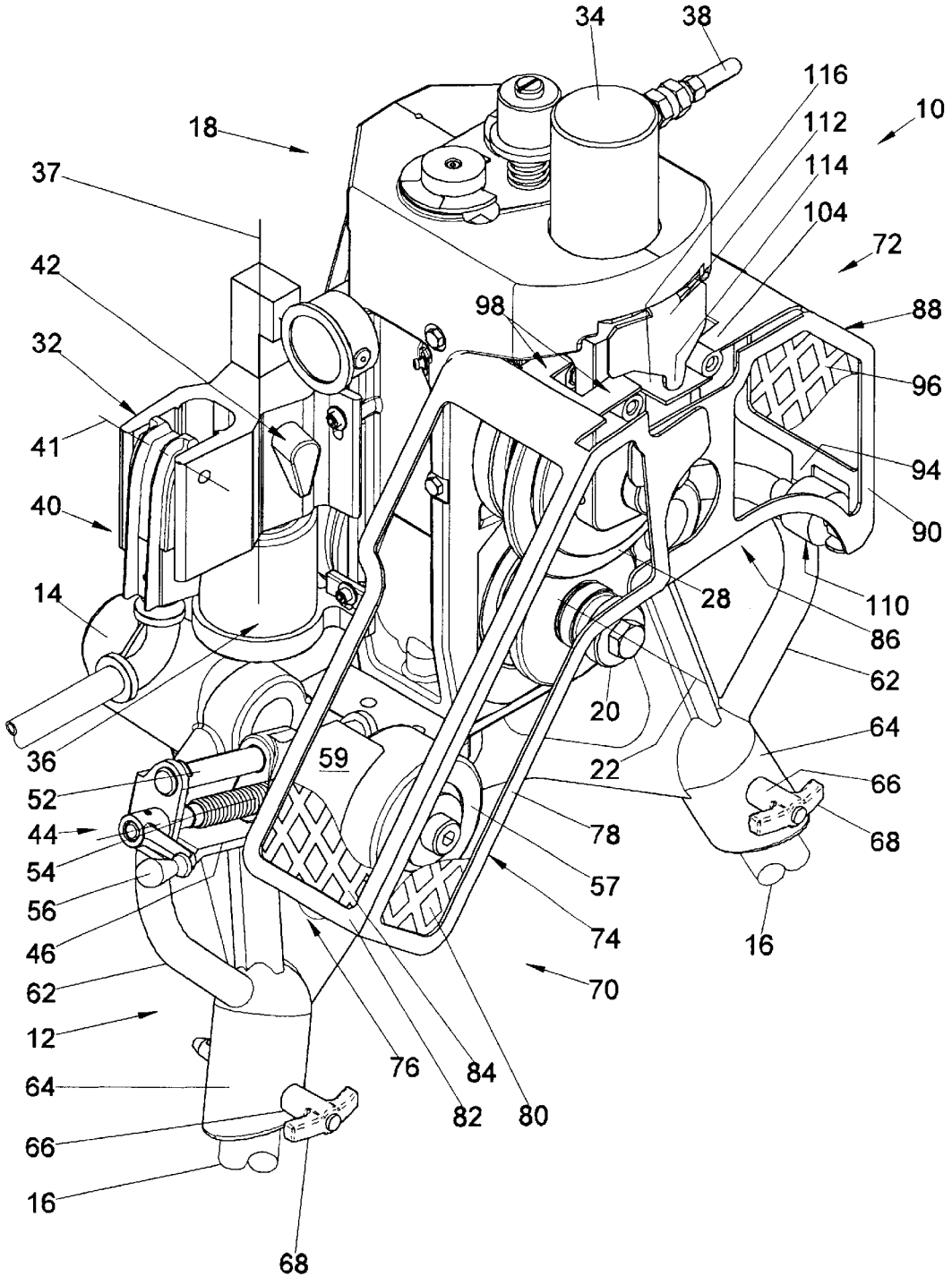
FIG. 3 is a perspective view of the apparatus and guard arrangement shown in FIGS. 1 and 2.
Figure 7:
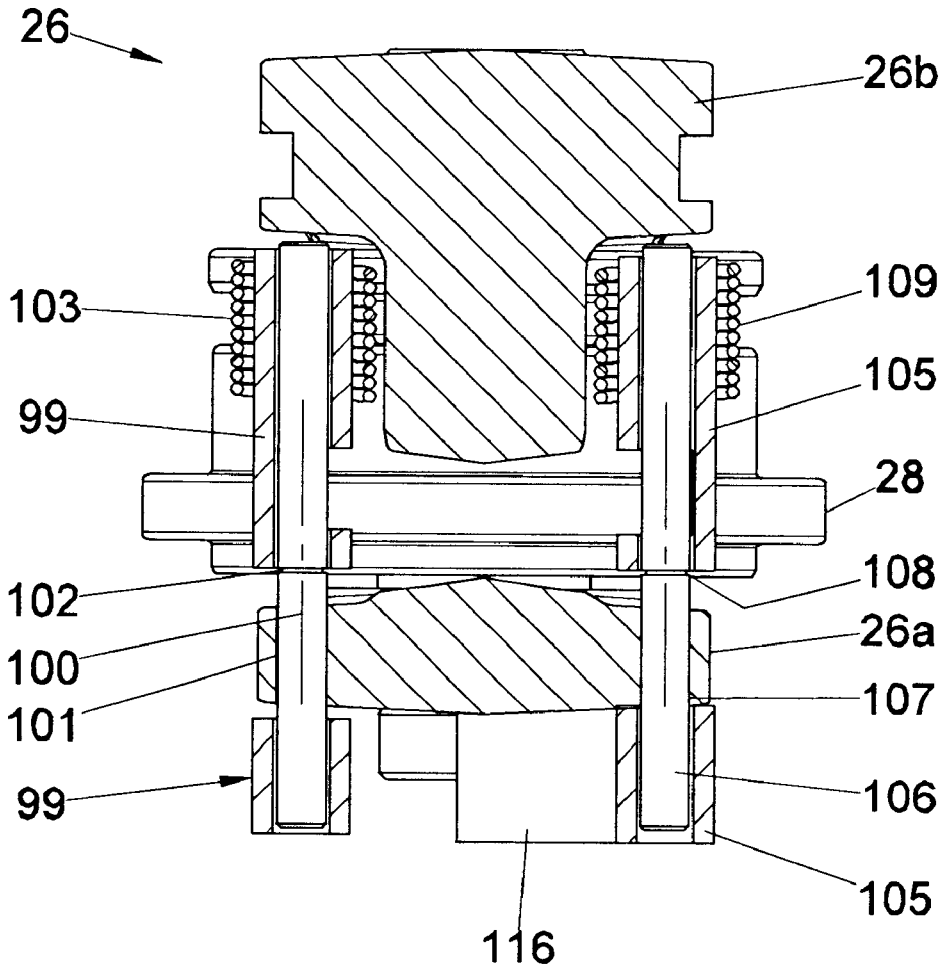

Each of the guards 70 and 72 is mounted on grooving roll support member 26 for displacement therewith and relative thereto and, preferably, each of the guards is pivotally mounted on the support member. More particularly in this respect, as best seen in FIGS. 3 and 7, the upper end of frame 82 of guard 70 is provided with laterally inwardly extending fingers 98 having tubes 99 welded on the laterally inner ends thereof for receiving a pivot shaft or pin 100 which is mounted on outer portion 26*a* of support member 26 parallel to the roll axes. More particularly, pin 100 extends through an opening 101 therefor in portion 26*a* of the support member, and fingers 98 and tubes 99 are on axially opposite sides of portion 26*a*. A split retaining ring, not shown, is received in a peripheral recess 102 in pin 100 to releasably mount guard 70 on support member 26. Guard 70 is pivotal in opposite directions relative to support member 26 about pin 100, and a coiled biasing spring 103 surrounds the axially inner tube 99 and engages between support member 26 and the latter tube to bias the guard counterclockwise in FIGS. 3–5 of the drawing. Similarly, the upper end of frame 94 of guard 72 includes laterally inwardly extending fingers 104, only one of which can be seen in FIG. 3, and which have tubes 105 welded on the laterally inner ends thereof for receiving a pivot pin 106 mounted on outer portion 26*a* of support member 26 parallel to the roll axes. Pin 106 extends through an opening 107 therefor in support portion 26*a*, and tubes 105 are on axially opposite sides of the support portion. As with guard 70, a split retaining ring, not shown, is received in a circumferential recess 108 in pin 106 to removably mount guard 72 on support member 26. Guard 72 is pivotal in opposite directions about pin 106, and a coiled spring 109 surrounds the axially inner tube 105 and engages between support member 26 and the latter tube to bias guard 72 to pivot clockwise in FIGS. 3–5 of the drawing.

Figure 5:
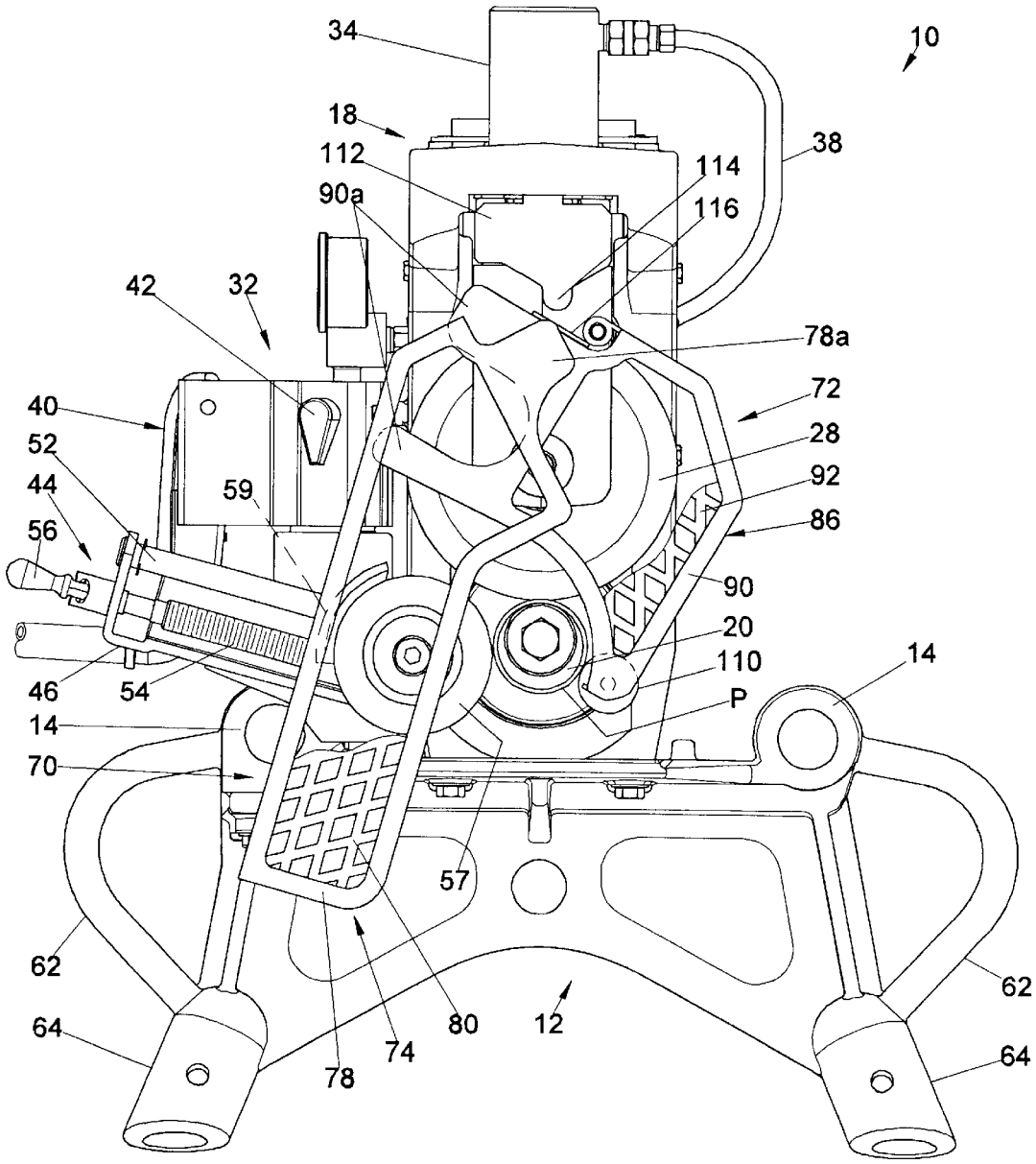
FIG. 5 is a front elevation view showing the roll grooving apparatus and guard arrangement in conjunction with the roll grooving of a small diameter pipe.

As best seen in FIGS. 3, 4 and 5, the laterally outer end of panel 76 of guard 70 engages against stabilizer wheel shield 59 and is biased thereagainst by spring 103, and as best seen in FIGS. 4 and 5, the laterally outer end of panel 88 of guard 72 engages a pipe P which is being roll grooved and is biased into engagement with the pipe by spring 109. Preferably, a roller 110 is mounted on the laterally outer end of frame 94 of panel 88 for engaging pipe P. As best seen in FIGS. 1 and 3–5, a downwardly extending stop plate 112 is mounted on roll support member 18 above guards 70 and 72 by means of a mounting plate portion 113 and mounting nut 35. Plate 112 has an abutment finger 114 overlying an actuator plate 116 on guard 72. Plate 116 extends laterally inwardly from the underside of the axially outer one of the tubes 105 on fingers 104 of frame 94 of guard 72. During a roll grooving operation, plate 116 is positioned relative to abutment 114 as shown in FIGS. 4 and 5. Upon the completion of a roll grooving operation, roll support member, 26 is displaced upwardly relative to roll support member 18, and thus stop plate 112, whereby plate 116 engages abutment 114 and causes guard 72 to pivot counterclockwise in FIGS. 4 and 5 and to a position considerably further in the counterclockwise direction from the position shown in FIG. 4. Such positioning of guard 72 together with displacement of stabilizer wheel 57 to the position thereof shown in FIG. 4 optimizes access to the grooving rolls such as for replacement thereof. As will be appreciated from the foregoing description, biasing springs 103 and 109 provide for the guards 70 and 72, respectively, to be constantly engaged with the corresponding one of the wheel shield of the stabilizer and a pipe being roll grooved. Accordingly, as will be appreciated from FIGS. 4 and 5, each of the guards is effectively positioned relative to the apparatus for each different size of pipe to be roll grooved. In this respect, spring 109 biases guard 72 into engagement with the pipe, regardless of the size thereof, and spring 103 biases guard 70 into engagement with the stabilizer, whereby the position of the guard is adjusted in conjunction with the adjustment of the position of the stabilizer wheel to engage a pipe of given diameter. As will be further appreciated from FIGS. 2–5, panels 74 and 86 of guards 70 and 72, respectively, are axially offset, whereby laterally inwardly extending portions 78*a* and 90*a* of frames 78 and 90 thereof, respectively, laterally overlap forwardly of idler roll 28. This reduces the open area that otherwise would exist between the laterally inner ends of the frames and increases the effectiveness of the guards.

As will be appreciated from the foregoing description and the contrast in positions of the guards in FIGS. 4 and 5 of the drawing, each guard is automatically positioned relative to a given size pipe and, accordingly, is constantly positioned most effectively with regard to a pipe being roll grooved. Moreover, while the invention has been described herein in conjunction with roll grooving apparatus having a stabilizer and guards on laterally opposite sides of the grooving rolls and respectively interposed between an operator and the stabilizer and grooving rolls on one of the laterally opposite sides and between an operator and the grooving rolls on the other of the opposite sides of the apparatus, it will be appreciated that a given roll grooving machine can have a single guard on either one of the laterally opposite sides of the grooving rolls, and that a roll grooving machine which does not have a stabilizer can have a guard similar to guard 72 on either one or both of the laterally opposite sides of the grooving rolls and respectively interposed between an operator and the grooving rolls on the corresponding side of the machine.

While considerable emphasis has been placed herein on the structures and structural interrelationships between the component parts of a preferred embodiment of the invention, it will be appreciated that other embodiments can be made and that many changes can be made in the embodiment herein illustrated and described without departing from the principals of the invention. In this respect, for example, the roll grooving apparatus could be mounted on a common stand with a power drive unit, or could be mounted on a bench or the like. Further, the displaceable grooving roll support could be displaced by a mechanical lever arrangement, a screw arrangement or the like, and in connection with hydraulic displacement of the roll support, the hydraulic pump could be horizontal rather than vertical. Further, the pump and stabilizer could be on opposite sides of the apparatus as opposed to being on the same side thereof, and the guards could be slidably displaceable relative to the roll support member on which they are mounted rather pivotally displaceable relative thereto. Still further, it will be appreciated that the guards can be constructed to have panels of material other than expanded metal, and the guards can be of expanded metal in their entirety including the frame portions. Further, the tubes for receiving the pivot pins for the guards could be integral with the frame and, for example, formed by rolling portions of the frame material. These and other modifications of the disclosed embodiment as well as other embodiments of the invention will be obvious or suggested from the disclosure herein, whereby it is to be distinctly understood that the foregoing descriptive matter is to be interpreted merely as illustrative of the invention and not as a limitation.

Having thus described the invention, it is so claimed:

1. In roll grooving apparatus for rolling a circumferential groove in a pipe comprising a first support, a first grooving roll rotatably mounted on said first support, a second support, a second grooving roll rotatably mounted on said second support, said second support being displaceable relative to said first support for displacing said second grooving roll toward and away from said first grooving roll, the improvement comprising: a guard mounted on said second support for displacement therewith and engaging a pipe being roll grooved during a roll grooving operation.

2. The improvement according to claim 1, wherein said guard is pivotally mounted on said second support.

3. The improvement according to claim 2, and a spring biasing said guard to engage a pipe being roll grooved.

4. The improvement according to claim 1, wherein said guard is displaceable relative to said second support, and a spring biasing said guard to engage a pipe being roll grooved.

5. The improvement according to claim 4, wherein said guard includes a roller for engaging a pipe being roll grooved.

6. The improvement according to claim 1, wherein said first grooving roll has a roll axis and said guard includes a first panel transverse to said roll axis and a second panel parallel to said roll axis.

7. The improvement according to claim 6, wherein at least a portion of at least one of said first and second panels is expanded metal.

8. The improvement according to claim 1, wherein said first grooving roll has a roll axis and said guard is displaceable relative to said second support, and a member on said first support for engaging and displacing said guard laterally outwardly relative to said roll axis during displacement of said second support to displace said second grooving roll away from said first grooving roll.

9. The improvement according to claim 8, and a spring biasing said guard to engage a pipe being roll grooved.

10. The improvement according to claim 9, wherein said guard is pivotally mounted on said second support.

11. The improvement according to claim 10, wherein said guard includes a roller for engaging a pipe being roll grooved.

12. The improvement according to claim 11, wherein said guard includes a first panel transverse to said roll axis and a second panel parallel to said roll axis.

13. The improvement according to claim 12, wherein at least a portion of at least one of said first and second panels is expanded metal.

14. In roll grooving apparatus for rolling a circumferential groove in a pipe comprising a first support, a first grooving roll rotatably mounted on said first support, a second support, a second grooving roll rotatably mounted on said second support, said second support being displaceable relative to said first support for displacing said second grooving roll toward and away from said first grooving roll, and a stabilizer on said first support for stabilizing a pipe to be roll grooved, the improvement comprising: a guard mounted on said second support for displacement therewith and engaging one of said stabilizer and a pipe being roll grooved during a roll grooving operation.

15. The improvement according to claim 14, wherein said guard is pivotally mounted on said second support.

16. The improvement according to claim 15, and a spring biasing said guard to engage said one of said stabilizer and a pipe being roll grooved.

17. The improvement according to claim 14, wherein said guard is displaceable relative to said second support, and a spring biasing said guard to engage said one of said stabilizer and a pipe being roll grooved.

18. The improvement according to claim 14, wherein said first grooving roll has a roll axis and said guard includes a first panel transverse to said roll axis and a second panel parallel to said roll axis.

19. The improvement according to claim 18, wherein at least a portion of at least one of said first and second panels is expanded metal.

20. The improvement according to claim 14, wherein said first grooving roll has a roll axis and said guard is displaceable relative to said second support, and a member on said first support for engaging and displacing said guard laterally outwardly of said roll axis during displacement of said second support to displace said second grooving roll away from said first grooving roll.

21. The improvement according to claim 20, and a spring biasing said guard to engage said one of said stabilizer and a pipe being roll grooved.

22. The improvement according to claim 21, wherein said guard is pivotally mounted on said second support.

23. The improvement according to claim 22, wherein said guard includes a roller engaging said one of said stabilizer and a pipe being roll grooved.

24. The improvement according to claim 23, wherein said guard includes a first panel transverse to said roll axis and a second panel parallel to said roll axis.

25. The improvement according to claim 24, wherein at least a portion of at least one of said first and second panels is expanded metal.

26. The improvement according to claim 21, wherein said guard includes a roller engaging said one of said stabilizer and a pipe being roll grooved.

27. In roll grooving apparatus for rolling a circumferential groove in a pipe comprising a first support, a first grooving roll rotatably mounted on said first support, a second support, a second grooving roll rotatably mounted on said second support, said second support being displaceable relative to said first support for displacing said second grooving roll toward and away from said first grooving roll, and a stabilizer on said first support for stabilizing a pipe to be roll grooved, the improvement comprising: a guard mounted on said second support for displacement therewith and engaging said stabilizer.

28. The improvement according to claim 27, wherein said guard is pivotally mounted on said second support.

29. The improvement according to claim 28, and a spring biasing said guard to engage said stabilizer.

30. The improvement according to claim 27, wherein said guard is displaceable relative to said second support, and a spring biasing said guard to engage said stabilizer.

31. The improvement according to claim 27, wherein said first grooving roll has a roll axis and said guard includes a first panel transverse to said roll axis and a second panel parallel to said roll axis.

32. The improvement according to claim 31, wherein at least a portion of at least one of said first and second panels is expanded metal.

33. The improvement according to claim 30, wherein said guard is pivotally mounted on said second support.

34. The improvement according to claim 33, wherein said first grooving roll has a roll axis and said guard includes a first panel transverse to said roll axis and a second panel parallel to said roll axis.

35. The improvement according to claim 34, wherein said second panel has an end engaging said stabilizer.

36. The improvement according to claim 34, wherein at least a portion of at least one of said first and second panels is expanded metal.

37. In a roll grooving apparatus for rolling a circumferential groove in a pipe comprising a first support, a first grooving roll rotatably mounted on said first support, a second support, a second grooving roll rotatably mounted on said second support, said second support being displaceable relative to said first support for displacing said second grooving roll toward and away from said first grooving roll, and a stabilizer on said first support for stabilizing a pipe to be roll grooved, the improvement comprising: first and second guards mounted on said second support for displacement therewith, said first guard engaging said stabilizer, and said second guard engaging a pipe being roll grooved during a roll grooving operation.

38. The improvement according to claim 37, wherein each said first and second guard is pivotally mounted on said second support.

39. The improvement according to claim 38, and a spring biasing each said first and second guard to engage the corresponding one of said stabilizer and a pipe being roll grooved.

40. The improvement according to claim 37, wherein each said first and second guard is displaceable relative to said second support, and a spring biasing each said first and second guard to engage the corresponding one of said stabilizer and a pipe being roll grooved.

41. The improvement according to claim 37, wherein said first grooving roll has a roll axis and each said first and second guard includes a first panel transverse to said roll axis and a second panel parallel to said roll axis.

42. The improvement according to claim 41, wherein at least a portion of at least one of said first and second panels is expanded metal.

43. The improvement according to claim 37, wherein said first grooving roll has a roll axis and said second guard is displaceable relative to said second support, and a member on said first support for engaging and displacing said second guard laterally outwardly of said roll axis during displacement of said second support to displace said second grooving roll away from said first grooving roll.

44. The improvement according to claim 43, wherein said second guard includes a roller for engaging a pipe being roll grooved.

45. The improvement according to claim 44, wherein said first guard is displaceable relative to said second support, and a spring biasing each said first and second guard to engage the corresponding one of said stabilizer and a pipe being roll grooved.

46. The improvement according to claim 45, wherein said first guard has an end spaced from said second support and engaging said stabilizer.

47. The improvement according to claim 45, wherein each said first and second guard is pivotally mounted on said second support.

48. The improvement according to claim 47, wherein said first grooving roll has a roll axis and each said first and second guard includes a first panel transverse to said roll axis and a second panel parallel to said roll axis.

49. The improvement according to claim 48, wherein at least a portion of at least one of said first and second panels is expanded metal.

50. The improvement according to claim 49, wherein said second panel of said first guard includes an end engaging said stabilizer.

51. The improvement according to claim 41, wherein the first panels of the first and second guards have overlapping laterally inner ends.

52. The improvement according to claim 48, wherein the first panels of the first and second guards have overlapping laterally inner ends.

* * * * *